US011402097B2

(12) United States Patent
Stieg et al.

(10) Patent No.: US 11,402,097 B2
(45) Date of Patent: Aug. 2, 2022

(54) COMBUSTOR ASSEMBLY FOR A TURBINE ENGINE

(71) Applicant: General Electric Company, Schenectady, NY (US)

(72) Inventors: Michael Alan Stieg, Cincinnati, OH (US); Nicholas John Bloom, Maineville, OH (US)

(73) Assignee: General Electric Company, Schenectady, NY (US)

( * ) Notice: Subject to any disclaimer, the term of this patent is extended or adjusted under 35 U.S.C. 154(b) by 315 days.

(21) Appl. No.: 15/860,820

(22) Filed: Jan. 3, 2018

(65) Prior Publication Data

US 2019/0203939 A1 Jul. 4, 2019

(51) Int. Cl.
*F23R 3/00* (2006.01)
*F23R 3/60* (2006.01)

(52) U.S. Cl.
CPC ..... *F23R 3/005* (2013.01); *F23R 3/007* (2013.01); *F23R 3/60* (2013.01); *F23R 2900/00005* (2013.01)

(58) Field of Classification Search
CPC .. F23R 3/005; F23R 3/60; F23R 2900/03044; F23R 2900/00005; F23R 3/06; F23R 3/002; F23R 3/04; F23R 2900/03042; F01D 25/10; F02C 3/14; F05D 2260/941; F05D 2240/35
See application file for complete search history.

(56) References Cited

U.S. PATENT DOCUMENTS 2,885,858 A * 5/1959 Lloyd ..... F23R 3/54 60/747
3,604,716 A 9/1971 Webert
3,842,595 A 10/1974 Smith et al.
4,363,208 A 12/1982 Hoffman et al.
4,424,667 A 1/1984 Fanning
4,474,014 A * 10/1984 Markowski ..... F23R 3/14 60/738
4,686,823 A 8/1987 Coburn et al.
(Continued)

FOREIGN PATENT DOCUMENTS

DE 102013220482 B3 4/2015
EP 1152191 A2 11/2001
(Continued)

OTHER PUBLICATIONS

U.S. Appl. No. 15/239,888, filed Aug. 18, 2016.
(Continued)

*Primary Examiner* — Ted Kim
(74) *Attorney, Agent, or Firm* — Dority & Manning, P.A.

(57) ABSTRACT

A combustor assembly for a gas turbine engine includes a dome defining a slot. The combustor assembly also includes a liner at least partially defining a combustion chamber and extending between an aft end and a forward end. The forward end is received within the slot of the dome. In one exemplary aspect, the combustor assembly includes features that warm the forward end of the liner during transient operation of the engine. Furthermore, the combustor assembly includes features that reduce the thermal gradient between the forward end and the other portions of the liner. In this way, improved durability of the liner may be achieved.

9 Claims, 10 Drawing Sheets

(56) References Cited

U.S. PATENT DOCUMENTS 4,896,510 A * 1/1990 Foltz ..... F23M 5/085 60/757
5,180,282 A 1/1993 Lenhart et al.
5,207,064 A 5/1993 Ciokajlo et al.
5,291,732 A 3/1994 Halila
5,291,733 A 3/1994 Halila
5,330,321 A 7/1994 Roberts et al.
5,353,587 A * 10/1994 Halila ..... F23R 3/002 60/39.37
H1380 H * 12/1994 Halila ..... F23R 3/007 60/757
5,392,614 A 2/1995 Coffinberry
5,406,787 A 4/1995 Terrier
5,465,571 A 11/1995 Clark
5,630,700 A 5/1997 Olsen et al.
5,680,767 A 10/1997 Lee et al.
5,724,816 A * 3/1998 Ritter ..... B23P 11/025 60/752
5,996,335 A 12/1999 Ebel
6,234,755 B1 5/2001 Bunker
6,265,078 B1 7/2001 Atmur et al.
6,282,905 B1 * 9/2001 Sato ..... F23R 3/002 60/752
6,284,089 B1 9/2001 Anderson et al.
6,383,602 B1 5/2002 Fric et al.
6,397,603 B1 * 6/2002 Edmondson ..... F23R 3/007 60/746
6,401,447 B1 6/2002 Rice et al.
6,408,628 B1 * 6/2002 Pidcock ..... F23R 3/002 60/752
6,435,514 B1 8/2002 Aksit et al.
6,436,507 B1 8/2002 Pannell
6,513,330 B1 2/2003 Rice et al.
6,610,385 B2 8/2003 Cairo
6,619,030 B1 9/2003 Seda et al.
6,655,148 B2 12/2003 Calvez et al.
6,775,985 B2 8/2004 Mitchell et al.
6,840,519 B2 1/2005 Dinc et al.
6,893,214 B2 5/2005 Alford et al.
6,904,757 B2 6/2005 Mitchell et al.
6,991,427 B2 1/2006 Scott
7,062,920 B2 6/2006 McMasters et al.
7,141,191 B2 11/2006 Engwall et al.
7,186,078 B2 3/2007 Tanaka
7,229,513 B2 6/2007 Keith et al.
7,237,389 B2 7/2007 Ryan et al.
7,249,462 B2 7/2007 Aumont et al.
7,328,580 B2 2/2008 Lee et al.
7,329,087 B2 2/2008 Cairo et al.
7,347,425 B2 3/2008 James
7,445,425 B2 11/2008 Ferra et al.
7,572,099 B2 8/2009 Addis
7,617,688 B2 11/2009 Biebel et al.
7,686,990 B2 3/2010 Gray
7,849,696 B2 12/2010 Snecma
7,950,234 B2 5/2011 Radonovich et al.
7,997,867 B1 8/2011 Shih et al.
8,057,179 B1 11/2011 Liang
8,057,181 B1 11/2011 Liang
8,141,370 B2 3/2012 Bulman et al.
8,141,371 B1 3/2012 Habarou et al.
8,161,752 B2 4/2012 Yankowich et al.
8,240,980 B1 8/2012 Liang
8,246,305 B2 8/2012 Lecuyer et al.
8,490,399 B2 7/2013 Nordlund
8,556,531 B1 10/2013 Bird et al.
8,572,981 B2 11/2013 Bunker
8,607,577 B2 12/2013 Ruberte et al.
8,689,586 B2 4/2014 Hirayama et al.
8,739,547 B2 6/2014 Jarmon et al.
8,753,073 B2 6/2014 Albers et al.
8,756,935 B2 6/2014 Duval et al.
8,776,525 B2 7/2014 Oechsle
8,834,056 B2 9/2014 Keith et al.
8,863,527 B2 10/2014 Holcomb et al.
8,863,528 B2 10/2014 Shei et al.
8,887,487 B2 11/2014 Kupratis et al.
8,905,711 B2 12/2014 Suciu et al.
8,942,256 B1 1/2015 Barth et al.
9,034,128 B2 5/2015 Lea et al.
9,039,364 B2 5/2015 Alvanos et al.
9,097,211 B2 8/2015 Martinez et al.
9,102,571 B2 8/2015 Szweda et al.
9,127,565 B2 9/2015 Keller et al.
9,169,736 B2 10/2015 Hayford et al.
9,255,487 B2 2/2016 Mayer et al.
9,423,129 B2 8/2016 Graves et al.
9,534,783 B2 1/2017 Dierberger et al.
9,587,832 B2 3/2017 Dierberger
9,644,843 B2 5/2017 Herborth
2002/0184886 A1 12/2002 Calvez
2004/0118122 A1 6/2004 Mitchell et al.
2004/0134198 A1 7/2004 Mitchell et al.
2005/0016178 A1 1/2005 Wasif et al.
2005/0135931 A1 6/2005 Nakaata et al.
2006/0038358 A1 2/2006 James
2006/0280955 A1 12/2006 Spitsberg et al.
2007/0128002 A1 6/2007 Geary et al.
2008/0112798 A1 5/2008 Seitzer et al.
2008/0155988 A1 * 7/2008 Commaret ..... F23R 3/04 60/755
2008/0286090 A1 11/2008 Okita
2010/0326078 A1 12/2010 Pieussergues et al.
2011/0097191 A1 4/2011 Bunker
2011/0219775 A1 9/2011 Jarmon et al.
2011/0271684 A1 11/2011 Corsmeier et al.
2011/0281114 A1 11/2011 Butler
2011/0293423 A1 12/2011 Bunker et al.
2011/0305583 A1 12/2011 Lee et al.
2013/0000324 A1 1/2013 Alvanos et al.
2013/0175015 A1 7/2013 Tanaka et al.
2013/0205787 A1 8/2013 Zelesky et al.
2013/0205791 A1 8/2013 Mongillo et al.
2013/0205792 A1 8/2013 Gleiner et al.
2013/0209229 A1 8/2013 Xu et al.
2013/0209236 A1 8/2013 Xu
2013/0209269 A1 8/2013 Gleiner et al.
2013/0227166 A1 8/2013 Ravindran et al.
2014/0190167 A1 7/2014 Shei et al.
2014/0271144 A1 9/2014 Landwehr et al.
2014/0363276 A1 12/2014 Vetters et al.
2015/0016971 A1 1/2015 Freeman
2015/0117452 A1 4/2015 Mosko
2015/0204447 A1 7/2015 Kloepfer
2015/0292402 A1 10/2015 Razak
2015/0330633 A1 11/2015 Graves et al.
2016/0001873 A1 1/2016 Schwarz
2016/0017738 A1 1/2016 Rogers et al.
2016/0047549 A1 2/2016 Landwehr et al.
2016/0094439 A1 3/2016 Ravindran et al.
2016/0102574 A1 4/2016 Peters
2016/0123187 A1 5/2016 Leslie et al.
2016/0131084 A1 5/2016 Kupratis et al.
2016/0201515 A1 7/2016 Chang
2016/0208700 A1 7/2016 Minnear et al.
2016/0215980 A1 7/2016 Chang
2016/0215981 A1 7/2016 Dery
2016/0265389 A1 9/2016 Jarmon
2016/0265430 A1 9/2016 Schwarz
2017/0058778 A1 3/2017 Bloom et al.
2017/0059160 A1 3/2017 Bloom et al.
2017/0059167 A1 3/2017 Bloom et al.

FOREIGN PATENT DOCUMENTS

EP 1265031 A1 12/2002
EP 1445537 A2 8/2004
EP 1719949 A2 11/2006
EP 1741981 A1 1/2007
EP 1777461 A2 4/2007
EP 2366678 A2 9/2011
EP 2466074 A1 6/2012
FR 3004518 A1 10/2014

(56) References Cited

FOREIGN PATENT DOCUMENTS

| | | | |
|---|---|---|---|
| FR | 3022480 | A1 | 12/2015 |
| WO | WO2013/188645 | A2 | 12/2013 |
| WO | WO2014/137444 | A2 | 9/2014 |
| WO | WO2014/189589 | A2 | 11/2014 |
| WO | WO2015/038274 | A1 | 3/2015 |

OTHER PUBLICATIONS

Pratt & Whitney, PurePower Engine Family Specs Chart, http://www.pw.utc.com/Content/PurePowerPW1000G_Engine/pdf/B-11_PurePowerEngineFamily_SpecsChart.pdf.
U.S. Appl. No. 15/189,044, filed Jun. 22, 2016.
U.S. Appl. No. 15/212,337, filed Jul. 18, 2016.
U.S. Appl. No. 15/417,710, filed Jan. 27, 2017.
U.S. Appl. No. 15/417,745, filed Jan. 27, 2017.
U.S. Appl. No. 15/417,399, filed Jan. 27, 2017.
U.S. Appl. No. 15/417,437, filed Jan. 27, 2017.
U.S. Appl. No. 15/417,602, filed Jan. 27, 2017.

* cited by examiner

COMBUSTOR ASSEMBLY FOR A TURBINE ENGINE

FIELD

The present subject matter relates generally to gas turbine engines, and more particularly to combustor assemblies for gas turbine engines.

BACKGROUND

A gas turbine engine generally includes a fan and a core arranged in flow communication with one another. Additionally, the core of the gas turbine engine general includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to atmosphere.

More commonly, non-traditional high temperature materials, such as ceramic matrix composite (CMC) materials, are being used as structural components within gas turbine engines. For example, given the ability of CMC materials to withstand relatively extreme temperatures, there is particular interest in replacing components within the combustion section of the gas turbine engine with CMC materials. More particularly, inner and outer liners of gas turbine engines are more commonly being formed of CMC materials.

In some instances during operation, gas turbine engines are controlled to rapidly increase power. For example, one or more gas turbine engines of an aircraft may be controlled to rapidly increase power when transitioning from taxi to takeoff. During such rapid power increases or transient state conditions, combustion gases are generated within a combustion chamber defined by inner and outer liners. As the combustion gases flow downstream through the combustion chamber, the combustion gases scrub along the liners, causing the liners to rapidly heat up. However, the forward ends of the liners, or the portions of the liners that attach with dome sections, typically do not heat up as quickly as the rest of their respective liners. The thermal lag at the forward ends of the liners may cause undesirable bending stress and strain on the liners. As gas turbine engines may undergo many rapid power increases over many engine cycles, such repeated stress and strain on the liners can negatively impact their durability.

In addition, during steady state operation of the gas turbine engine, the forward ends of the liners remain cooler than the downstream portions of the liners that are scrubbed by the combustion gases. As such, there is a thermal gradient along the length of the liners with the forward ends being cooler than the downstream portions of the liners. The thermal gradient causes bending stress and strain on the liners, which as noted above, impacts their durability and service lives.

Accordingly, a combustor assembly of a gas turbine engine that includes features that reduce the stress and strain on combustion liners of the combustor assembly during transient and steady state operations of the gas turbine engine would be useful.

BRIEF DESCRIPTION

Aspects and advantages of the invention will be set forth in part in the following description, or may be obvious from the description, or may be learned through practice of the invention.

In one exemplary embodiment of the present disclosure, a combustor assembly for a gas turbine engine defining an axial direction, a radial direction, and a circumferential direction is provided. The combustor assembly includes a liner at least partially defining a combustion chamber and extending between an aft end and a forward end, wherein the liner defines a warming passage extending between an inlet and an outlet, wherein the inlet is positioned aft of the outlet and the outlet is defined by the forward end of the liner.

In another exemplary aspect of the present disclosure, a combustor assembly for a gas turbine engine defining an axial direction, a radial direction, and a circumferential direction is provided. The combustor assembly includes a dome defining a slot. The combustor assembly also includes a liner at least partially defining a combustion chamber and extending between an aft end and a forward end, the forward end of the liner received within the slot of the dome. Further, the combustor assembly includes a baffle extending between an aft end and a forward end, the forward end of the baffle attached to the dome, the baffle spaced from the liner in a direction opposite the combustion chamber along the radial direction. In addition, a warming passage is defined between the liner and the baffle, the warming passage extending between an inlet and outlet, and wherein the baffle defines the inlet of the warming passage aft of the forward end of the liner and the outlet is at least partially defined by the forward end of the liner.

In yet another exemplary aspect of the present disclosure, a method for warming a forward end of a liner of a combustor assembly for a gas turbine engine is provided. The gas turbine engine defining a radial direction and an axial direction. The liner at least partially defining a combustion chamber and at least partially defining a warming passage. The warming passage extending between an inlet and an outlet, the inlet positioned upstream of the outlet and the outlet at least partially defined by the forward end of the liner. The method includes operating the gas turbine engine to generate a pressurized airflow. The method also includes flowing the pressurized airflow through the warming passage from the inlet to the outlet so as to warm the forward end of the liner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
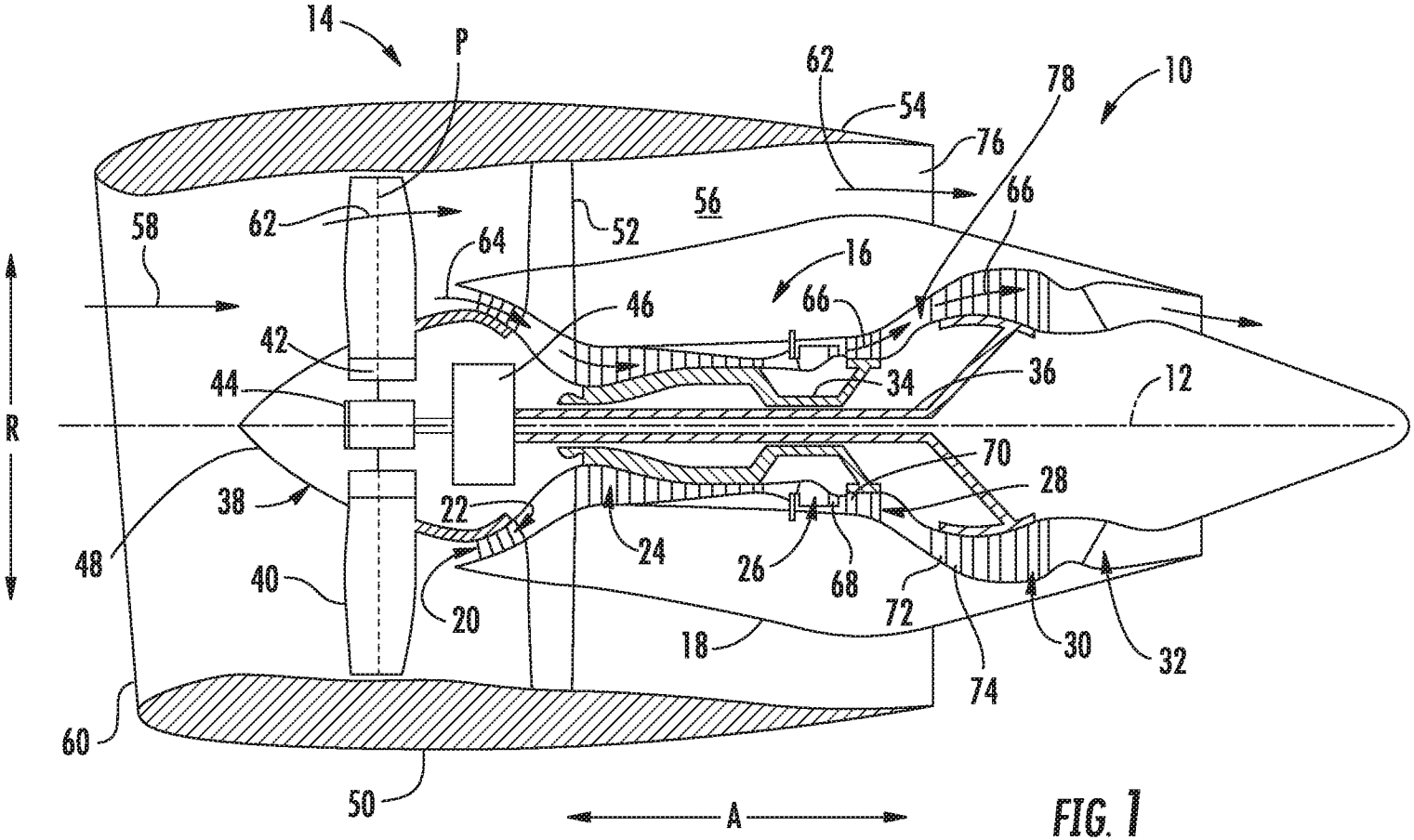
FIG. 1 provides a schematic cross-sectional view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "forward" and "aft" refer to relative positions within a gas turbine engine, with forward referring to a position closer to an engine inlet and aft referring to a position closer to an engine nozzle or exhaust. The terms "upstream" and "downstream" refer to the relative direction with respect to fluid flow in a fluid pathway. For example, "upstream" refers to the direction from which the fluid flows, and "downstream" refers to the direction to which the fluid flows. It should be appreciated, that as used herein, terms of approximation, such as "about" and "approximately," refer to being within a ten percent (10%) margin of error.

Exemplary aspects of the present disclosure are directed to combustor assemblies for gas turbine engines that include features for warming a forward end of a liner during transient and steady state operation of the engine. In one exemplary aspect, a combustor assembly includes a dome defining a slot and a liner that at least partially defines a combustion chamber. The liner extends between an aft end and a forward end. At least a portion of the forward end is received within the slot of the dome. The liner defines a warming passage extending between an inlet and an outlet. The inlet is positioned aft of the outlet (or upstream relative to the fluid flow through the engine) and the outlet is defined by the forward end of the liner. Accordingly, during operation of the engine, an airflow can flow into the warming passage and heat generated by the combustion gases can conduct through the liner and transfer heat to the airflow. The warmed airflow flows toward the forward end of the liner to warm the forward end. By warming the forward end of the liner, the stress and strain on the liner during transient operating conditions may be reduced, particularly during transient engine power increases or bursts. Additionally, as warming air is continuously fed to the forward end via the warming passage, the forward end is warmed to a higher temperature that is closer the remaining portions of the liner during steady state operation. Accordingly, the thermal gradient of the liner may be reduced, which ultimately reduces the stress and strain on the liner during steady state operating conditions. By reducing the stress and strain on the liner, improved durability may be achieved.

FIG. 1 provides a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference), a radial direction R, and a circumferential direction (i.e., a direction extending about the axial direction A; not depicted). In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable spinner or front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It should be appreciated that the exemplary turbofan engine 10 depicted in FIG. 1 is by way of example only, and that in other exemplary embodiments, the turbofan engine 10 may have any suitable configuration. For example, the present disclosure matter may be suitable for use with or in turboprops, turboshafts, turbojets, reverse-flow engines, industrial and marine gas turbine engines, and/or auxiliary power units.

Figure 2:
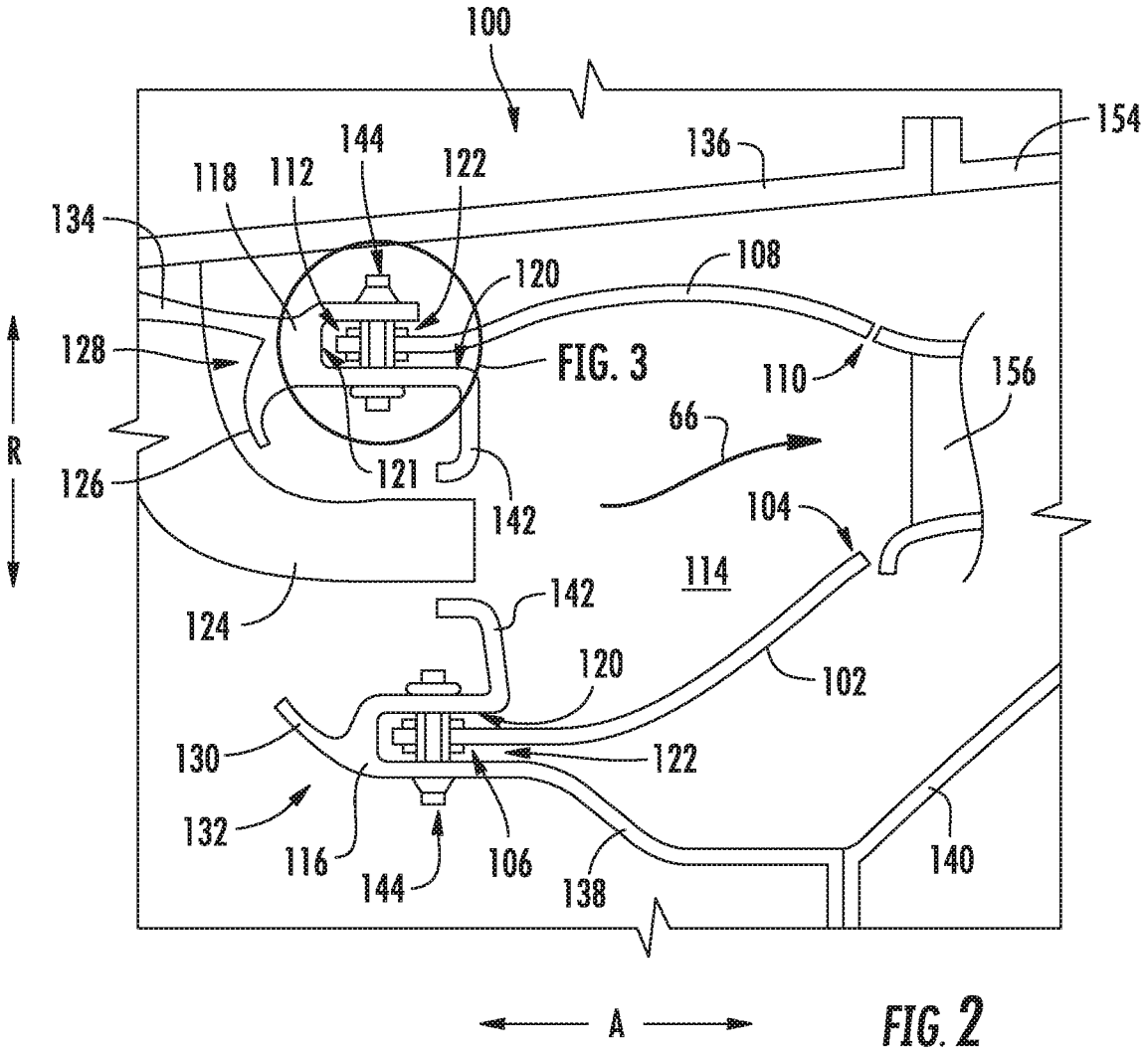
FIG. 2 provides a schematic, cross-sectional view of a combustor assembly in accordance with an exemplary embodiment of the present disclosure.

FIG. 2 provides a close-up cross-sectional view of a combustor assembly 100 in accordance with an exemplary embodiment of the present disclosure. For example, the combustor assembly 100 of FIG. 2 may be positioned in the combustion section 26 of the exemplary turbofan engine 10 of FIG. 1. More particularly, FIG. 2 provides a side, cross-sectional view of the exemplary combustor assembly 100 of FIG. 2.

As shown, the combustor assembly 100 includes an inner liner 102 extending between an aft end 104 and a forward end 106 generally along the axial direction A, as well as an outer liner 108 also extending between an aft end 110 and a forward end 112 generally along the axial direction A. The inner and outer liners 102, 108 together at least partially define a combustion chamber 114 therebetween. The inner and outer liners 102, 108 are each attached to an annular dome. More particularly, the annular dome includes an inner dome section 116 attached to the forward end 106 of the inner liner 102 and an outer dome section 118 attached to the forward end 112 of the outer liner 108. The inner and outer dome sections 116, 118 may be formed integrally (or alternatively may be formed of a plurality of components attached in any suitable manner) and may each extend along the circumferential direction C to define an annular shape. As will be discussed in greater detail below with reference to FIG. 3, the inner and outer dome sections 116, 118 each include an inner surface 120 (i.e., inner relative to their respective forward ends) and a forward surface 121 at least partially defining a slot 122 for receipt of the forward end 106 of the inner liner 102, and the forward end 112 of the outer liner 108, respectively.

The combustor assembly 100 further includes a plurality of fuel air mixers 124 spaced along a circumferential direction C and positioned at least partially within the annular dome. More particularly, the plurality of fuel air mixers 124 are disposed at least partially between the outer dome section 118 and the inner dome section 116 along the radial direction R. Compressed air from the compressor section of the turbofan engine 10 flows into or through the fuel air mixers 124, where the compressed air is mixed with fuel and ignited to create the combustion gases 66 (FIG. 1) within the combustion chamber 114. The inner and outer dome sections 116, 118 are configured to assist in providing such a flow of compressed air from the compressor section into or through the fuel air mixers 124. For example, the outer dome section 118 includes an outer cowl 126 at a forward end 128 and the inner dome section 116 similarly includes an inner cowl 130 at a forward end 132. The outer cowl 126 and inner cowl 130 may assist in directing the flow of compressed air from the compressor section into or through one or more of the fuel air mixers 124.

Moreover, the inner and outer dome sections 116, 118 each include attachment portions configured to assist in mounting the combustor assembly 100 within the turbofan engine 10 (FIG. 1). For example, the outer dome section 118 includes an attachment extension 134 configured to be mounted to an outer combustor casing 136 and the inner dome section 116 includes a similar attachment extension 138 configured to attach to an annular support member 140 within the turbofan engine 10. In certain exemplary embodiments, the inner dome section 116 may be formed integrally as a single annular component, and similarly, the outer dome section 118 may also be formed integrally as a single annular component. It should be appreciated, however, that in other exemplary embodiments, the inner dome section 116 and/or the outer dome section 118 may alternatively be formed by one or more components being joined in any suitable manner. For example, with reference to the outer dome section 118, in certain exemplary embodiments, the outer cowl 126 may be formed separately from the outer dome section 118 and attached to the forward end 128 of the outer dome section 118 using, e.g., a welding process. Similarly, the attachment extension 134 may also be formed separately from the outer dome section 118 and attached to the forward end 128 of the outer dome section 118 using, e.g., a welding process. Additionally or alternatively, the inner dome section 116 may have a similar configuration.

With reference still to FIG. 2, the exemplary combustor assembly 100 further includes a heat shield 142 positioned around the fuel air mixer 124 depicted. For this embodiment, the exemplary heat shield 142 is attached to and extends between the outer dome section 118 and the inner dome section 116. The heat shield 142 is configured to protect certain components of the turbofan engine 10 (FIG. 1) from the relatively extreme temperatures of the combustion chamber 114.

For the embodiment depicted, the inner liner 102 and the outer liner 108 are each formed of a ceramic matrix composite (CMC) material, which is a non-metallic material having high temperature capability. Exemplary CMC materials utilized for such liners 102, 108 may include silicon carbide, silicon, silica or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). CMC materials may have coefficients of thermal expansion in the range of about $1.3\times10^{-6}$ in/in/° F. to about $3.5\times10^{-6}$ in/in/° F. in a temperature of approximately 1000-1200° F.

By contrast, the annular dome, including the inner dome section 116 and outer dome section 118, may be formed of a metal, such as a nickel-based superalloy (having a coefficient of thermal expansion of about $8.3\text{-}8.5\times10^{-6}$ in/in/° F. in a temperature of approximately 1000-1200° F.) or cobalt-based superalloy (having a coefficient of thermal expansion of about $7.8\text{-}8.1\times10^{-6}$ in/in/° F. in a temperature of approximately 1000-1200° F.).

Referring still to FIG. 2, as noted above, the combustion gases 66 (FIG. 1) flow from the combustion chamber 114 into and through the turbine section of the turbofan engine 10 (FIG. 1) where a portion of thermal and/or kinetic energy from the combustion gases 66 is extracted via sequential stages of turbine stator vanes and turbine rotor blades. A stage one (1) turbine nozzle 156 is depicted schematically in FIG. 2 positioned aft of the combustor assembly 100.

Figure 3:
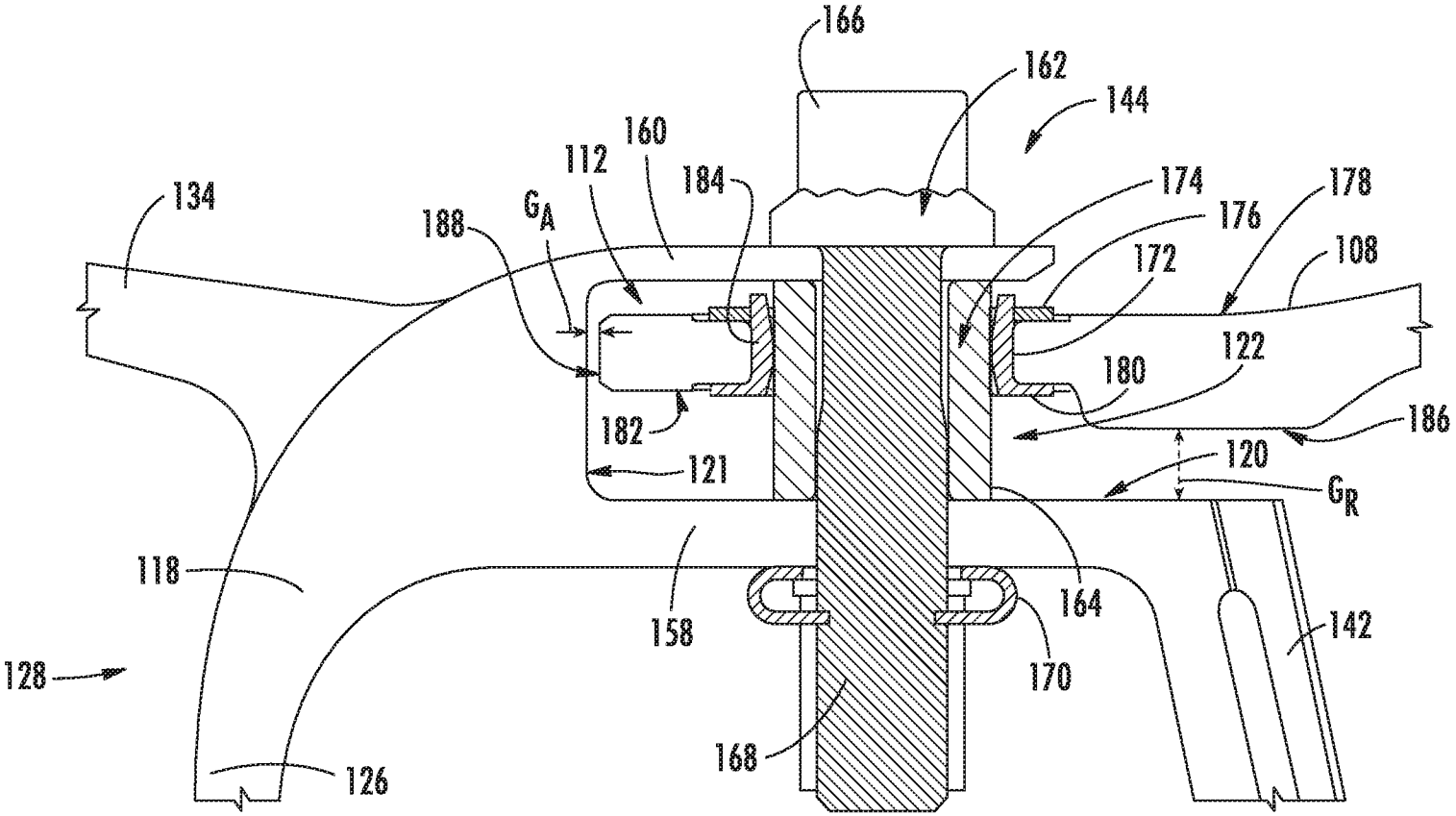
FIG. 3 provides a close up, cross-sectional view of an attachment point of the exemplary combustor assembly of FIG. 2, where a forward end of an outer liner is attached to an outer dome section.

FIG. 3 provides a close up, schematic, cross-sectional view of an attachment point where the forward end 112 of the outer liner 108 is mounted to the outer dome section 118 within the slot 122 of the outer dome section 118. To allow for a relative thermal expansion between the outer liner 108 and the outer dome section 118, as well as between the inner liner 102 and the inner dome section 116 (FIG. 2), a plurality of mounting assemblies 144 are used to attach the outer liner 108 to the outer dome section 118 and the inner liner 102 to the inner dome section 116. More particularly, the mounting assemblies 144 attach the forward end 112 of the outer liner 108 to the outer dome section 118 within the slot 122 of the outer dome section 118 as shown in FIGS. 2 and 3 and the forward end 106 of the inner liner 102 to the inner dome section 116 within the slot 122 of the inner dome section 116 (FIG. 2). The slots 122 are defined by their respective domes. Moreover, the slots 122 receive the forward ends 106, 112 of the inner and outer liners 102, 108, respectively.

Referring particularly to the forward end 112 of the outer liner 108 and the outer dome section 118 depicted in FIG. 3, the outer dome section 118 includes a base plate 158 and a yolk 160. The base plate 158 and the yolk 160 are spaced along the radial direction R. The base plate 158 and the yolk 160 each extend substantially parallel to one another, which for the embodiment depicted is a direction substantially parallel to the axial direction A of the turbofan engine 10 (see also FIG. 2). Notably, the slot 122 is defined between the base plate 158 and the yolk 160. The slot 122 is further defined by the forward surface 121. Further, in certain exemplary embodiments, the yolk 160 may extend circumferentially with the outer dome section 118, tracking the base plate 158. With such a configuration, the slot 122 may be considered an annular slot. However, in other embodiments, the yolk 160 may include a plurality of circumferentially spaced tabs, each of the individual tabs of the yolk 160 defining individual segmented portions of the slot 122 with the base plate 158.

The exemplary mounting assembly 144 depicted includes the yolk 160 of the outer dome section 118 and the base plate 158 of the outer dome section 118. Moreover, the mounting assembly 144 includes a pin 162 and a bushing 164. The pin 162 includes a head 166 and a shank 168. The shank 168 extends through the yolk 160, the forward end 112 of the outer liner 108 (positioned in slot 122), and the base plate 158. A nut 170 is attached to a distal end of the shank 168 of the pin 162. In certain exemplary embodiments, the pin 162 may be configured as a bolt and the nut 170 may be rotatably engaged with a threaded portion of the pin 162 (at, e.g., the distal end of the shank 168) for tightening the mounting assembly 144. Alternatively, however, in other exemplary embodiments the pin 162 and nut 170 may have any other suitable configurations. In other exemplary embodiments, for instance, the pin 162 may include a shank 168 defining a substantially smooth cylindrical shape and the nut 170 may be configured as a clip.

Additionally, the bushing 164 is generally cylindrical in shape and is positioned around the shank 168 of the pin 162 within the slot 122. For the embodiment depicted, the bushing 164 is pressed between the yolk 160 and the base plate 158 by tightening the nut 170 on the pin 162. Moreover, for the embodiment depicted, the mounting assembly 144 includes a metal grommet 172 positioned around the bushing 164 and pin 162. The grommet 172 is positioned in a mounting opening 174 defined by the forward end 112 of the outer liner 108. The diameter of the mounting opening 174 may range between or about between 0.400 and 0.800 inches (10.16-20.32 mm). The grommet 172 includes an outer collar 176 positioned adjacent to an outer surface 178 of the outer liner 108 and an inner collar 180 positioned adjacent to an inner surface 182 of the outer liner 108. The grommet 172 additionally includes a body 184. The metal grommet 172 may reduce an amount of wear on the forward end 112 of the outer liner 108 as the outer liner 108 moves inwardly and outwardly generally along the radial direction R relative to the outer dome section 118.

It should be appreciated, however, that although the forward end 112 of the outer liner 108 is attached to the outer dome section 118 using the exemplary mounting assembly 144 depicted and described herein, in other embodiments of the present disclosure, the mounting assembly 144 may have other suitable configurations, and further still in other embodiments, any other suitable attachment assembly may be used.

Referring still to FIG. 3, the forward end 112 of the outer liner 108 depicted further includes an axial interface surface 186 and a radial interface surface 188. The axial interface surface 186 is configured as a portion of the forward end 112 of the outer liner 108 facing the base plate 158 of the outer dome section 118, or more particularly, facing the inner surface 120 of the outer dome section 118. The radial interface surface 188 is configured as a portion of the forward end 112 of the outer liner 108 facing the forward surface 121 of the outer dome section 118. For the embodiment depicted, the axial interface surface 186 and inner surface 120 each extend in a direction parallel to the axial direction A, and the radial interface surface 188 and forward surface 121 each extend in a direction parallel to the radial direction R.

Moreover, as further shown in FIG. 3, the axial interface surface 186 defines a radial gap $G_R$ with the inner surface 120 of the outer dome section 118 and the radial interface surface 188 defines an axial gap $G_A$ with the forward surface 121 of the outer dome section 118. The combustor assembly 100 may be designed such that the radial and axial gaps $G_R$, $G_A$ allow for only a predetermined amount of airflow therethrough into the combustion chamber 114. Notably, allowing such a flow of air during operating conditions of the combustor assembly 100 may ensure relatively hot combustion gases within the combustion chamber 114 do not flow into and/or through the slot 122 of the outer dome section 118, potentially damaging certain components of the combustor assembly 100.

In addition to the airflow through the radial and axial gaps $G_R$, $G_A$, in some exemplary embodiments as will be explained more fully below, airflow may be provided to warm the forward end 112 of the outer liner 108 (as well as the forward end 106 of the inner liner 102 depicted in FIG. 2) to improve the thermal response (e.g., reduce the thermal lag) of the forward ends 112, 106 of the outer and inner liners 108, 102 during transient operation of the turbofan engine 10 (FIG. 1) and may reduce or eliminate the thermal gradient between the forward ends 112, 106 and the other portions of their respective liners 108, 102 during steady state operation. In this way, the stress and strain on the outer and inner liners 108, 102 can be reduced during transient and steady state operation of the engine.

Figure 4:
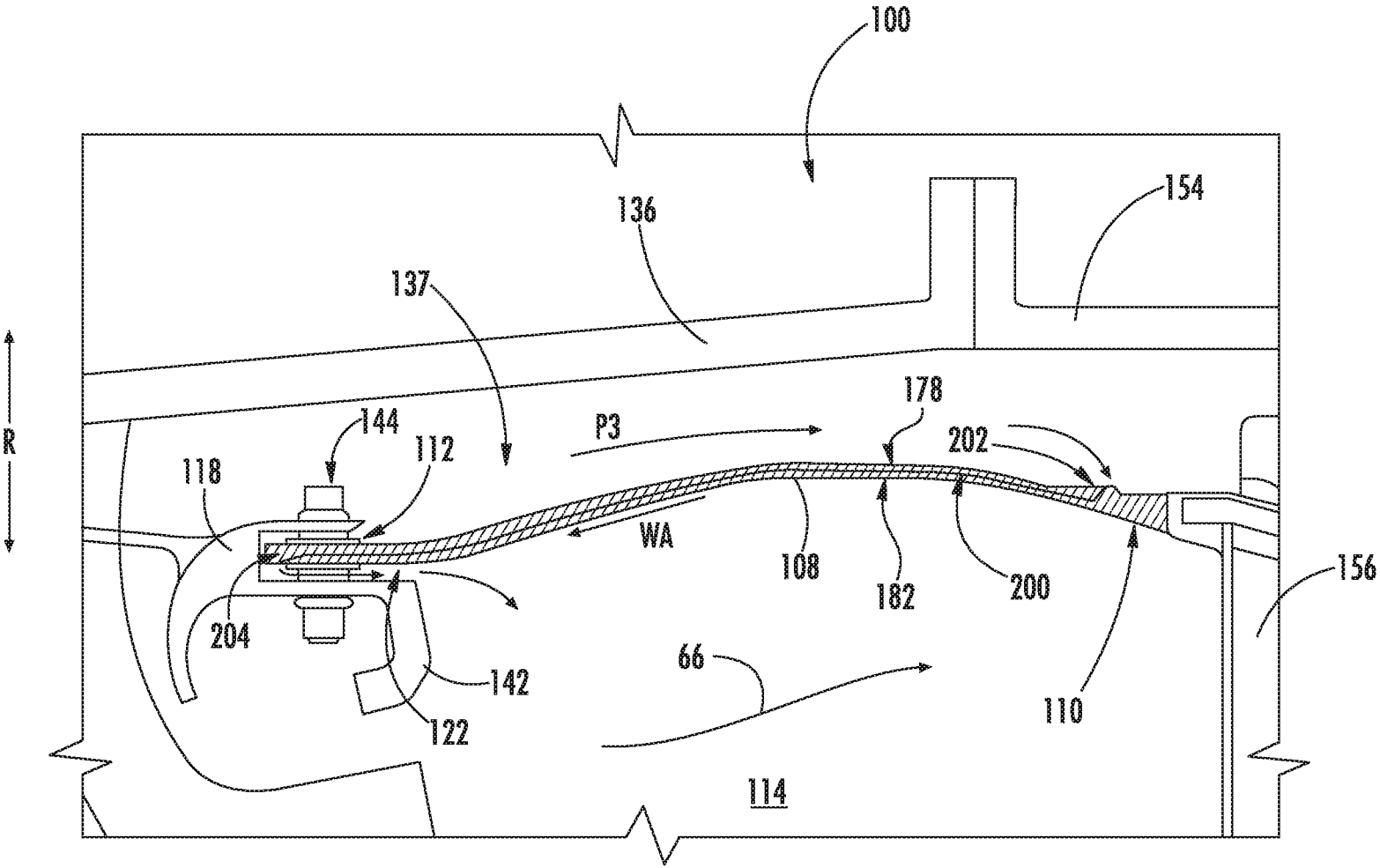
FIG. 4 provides a schematic, cross-sectional view of one exemplary embodiment of a combustor assembly depicting a forward end of an outer liner attached to an outer dome section and the liner defining a warming passage in accordance with an exemplary embodiment of the present disclosure.
Figure 6:
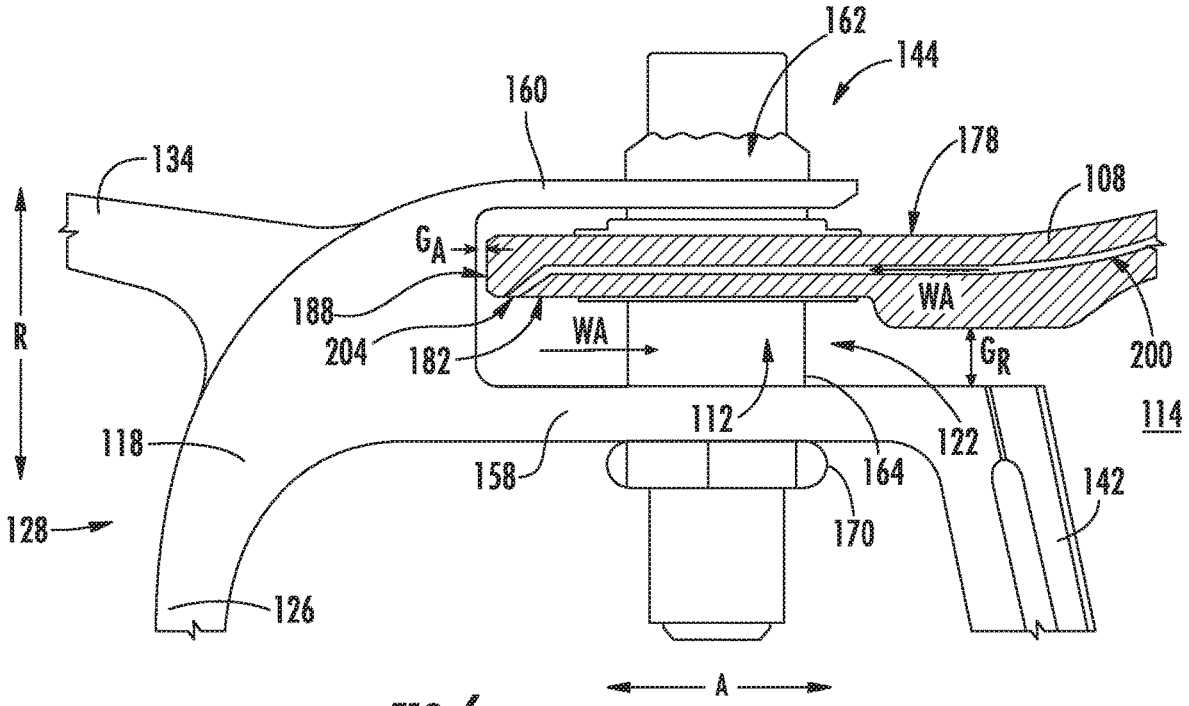
FIG. 6 provides a close up, cross-sectional view of one exemplary embodiment of a combustor assembly depicting a forward end of an outer liner attached to an outer dome section and further depicting a warming passage defined by the outer liner.

FIG. 4 provides a schematic, cross-sectional view of one exemplary embodiment of combustor assembly 100 depicting forward end 112 of outer liner 108 attached to outer dome 118. In addition, FIG. 4 depicts the outer liner 108 defining a warming passage 200 in accordance with an exemplary embodiment of the present disclosure. As shown, the warming passage 200 is defined by the outer liner 108 approximately midway between its outer surface 178 and inner surface 182 along the radial direction R. Further, the warming passage 200 extends between an inlet 202 and an outlet 204. For this embodiment, the inlet 202 is defined by the outer liner 108 proximate the aft end 110 of the outer liner 108 along the axial direction A and the outlet 204 is defined by the forward end 112 of the outer liner 108, and more particularly, the outlet 204 is defined by the forward end 112 forward of mounting assembly 144. Thus, the inlet 202 is positioned axially aft of the outlet 204. Stated alternatively, the inlet 202 is positioned upstream of the outlet 204 relative to the flow of combustion gasses 66 through combustion chamber 114. Further, for this embodiment, the inlet 202 is defined by the outer surface 178 of the outer liner 108 and the outlet 204 is defined by the inner surface 182 of the outer liner 108 at its forward end 112. FIG. 6 provides a close up view of the forward end 112 of the outer liner 108 of FIG. 4 attached to outer dome 118 with warming passage 200 shown defined by the outer liner 108.

During operation of the turbofan engine 10 (FIG. 1), with reference to FIG. 4, pressurized air P3 (e.g., compressor discharge air) is discharged from the compressor section (FIG. 1). A portion of the pressurized air P3 flows aft in the axial direction A in or through an outer plenum 137 defined between the outer liner 108 and the outer combustor casing 136. As the pressurized air P3 flows aft toward the aft end 110 of the outer liner 108, some of the pressurized air P3 flows into the inlet 202 of the warming passage 200. The pressurized air P3 then flows in a forward direction along the axial direction A, or stated alternatively, the pressurized air P3 flows upstream relative to the combustion gasses 66 generated within the combustion chamber 114. As the pressurized air P3 flows through warming passage 200, heat conducting through the outer liner 108 transfers to the pressurized air P3, thereby generating a warming airflow WA within the warming passage 200. That is, heat conducts through the outer liner 108 from its hot inner surface 182 radially outward toward warming passage 200. The heat is transferred to the pressurized air P3 to generate the warming airflow WA, which is warmed pressurized air. The warming airflow WA continues forward through the warming passage 200 and eventually reaches the forward end 112 of the outer liner 108. As the warming airflow WA travels through the warming passage 200 through the forward end 112, the warming airflow WA exchanges heat with the relatively cooler forward end 112. In this way, the forward end 112 is warmed. The warming airflow WA exits the warming passage 200 through outlet 204. After exiting the outlet 204, the warming airflow WA flows aft through slot 122 along the axial direction A toward the combustion chamber 114. As the warming airflow WA flows aft through slot 122, some of the warming airflow WA scrubs along the inner surface 182 of the outer liner 108, which provides additional warming of the forward end 112. By warming the forward end 112 of the outer liner 108, the thermal response of the forward end 112 can be improved during transient operations of the turbofan engine 10 (FIG. 1), and in addition, the thermal gradient between the forward end 112 and the other portions of outer liner 108 can be reduced or eliminated during steady state operation. In this manner, as noted above, the stress and strain on the outer liner 108 can be reduced during transient and steady state operation of the engine.

Figure 5:
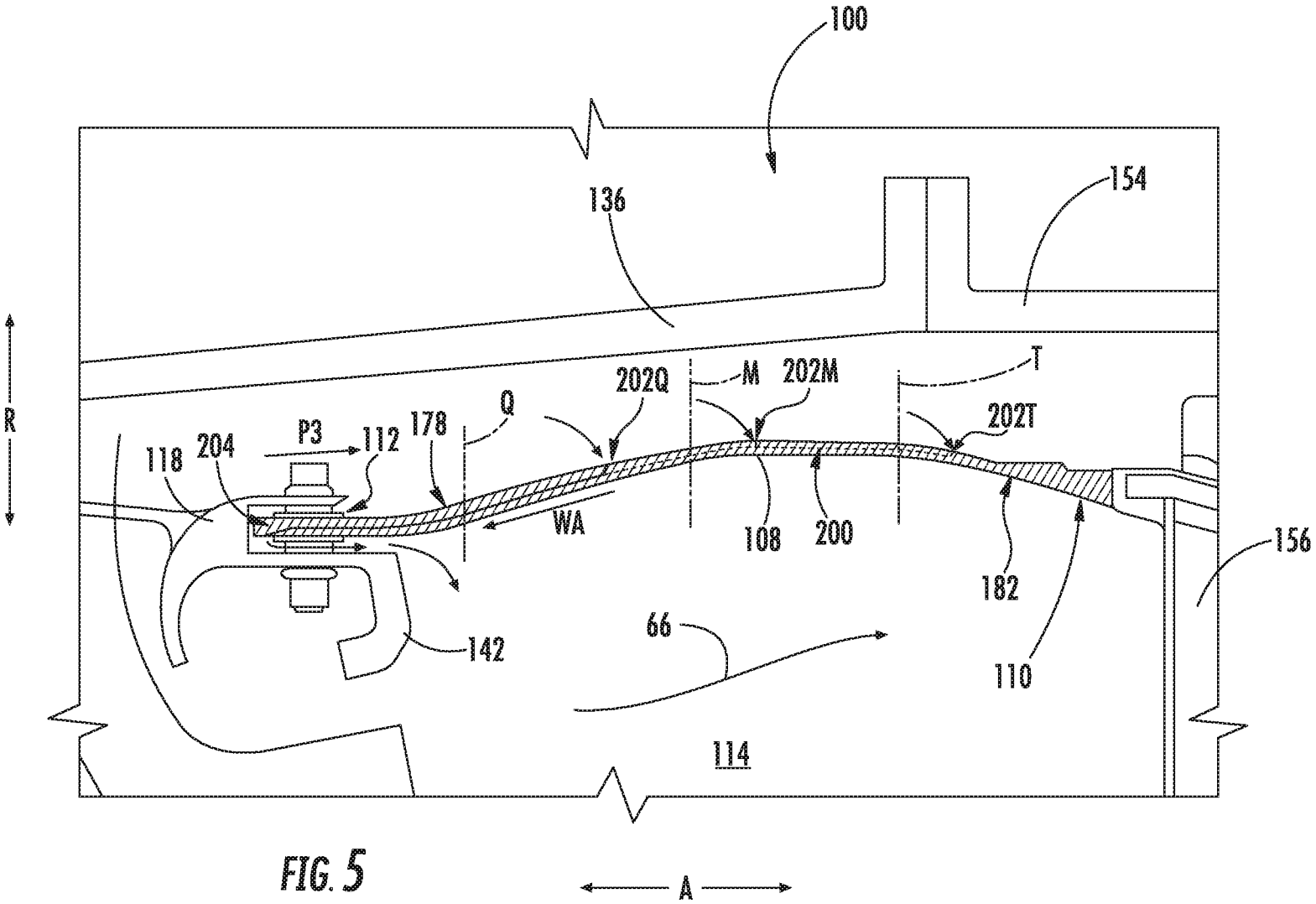
FIG. 5 provides a schematic, cross-sectional view of various exemplary embodiments of a combustor assembly depicting a forward end of an outer liner attached to an outer dome section and further depicting the outer liner defining a warming passage.

FIG. 5 provides a schematic, cross-sectional view of exemplary embodiments of combustor assembly 100 depicting forward end 112 of outer liner 108 attached to outer dome 118 and outer liner 108 defining warming passage 200 (shown partially in dotted lines in FIG. 5). In some embodiments, as shown in FIG. 5, the outer liner 108 defines a midplane M between the aft end 110 and the forward end 112 of the outer liner 108. Further, the outer liner 108 defines a quarter plane Q between the midplane M and its forward end 112 and a three-quarter plane T between the midplane M and its aft end 110. In some embodiments, the inlet of the warming passage 200 is defined by the outer liner 108 at or aft of the midplane M. For instance, as shown in FIG. 5, the inlet 202M is defined by outer liner 108 aft of the midplane M. In yet other embodiments, the inlet is defined by the outer liner 108 at or aft of the quarter plane Q. For instance, as shown in FIG. 5, the inlet 202Q is defined by outer liner 108 aft of the quarter plane Q. In further exemplary embodiments, the inlet is defined by the outer liner 108 at or aft of the three-quarter plane T. For instance, as shown in FIG. 5, the inlet 202T is defined by outer liner 108 aft of the three-quarter plane T.

Figure 7:
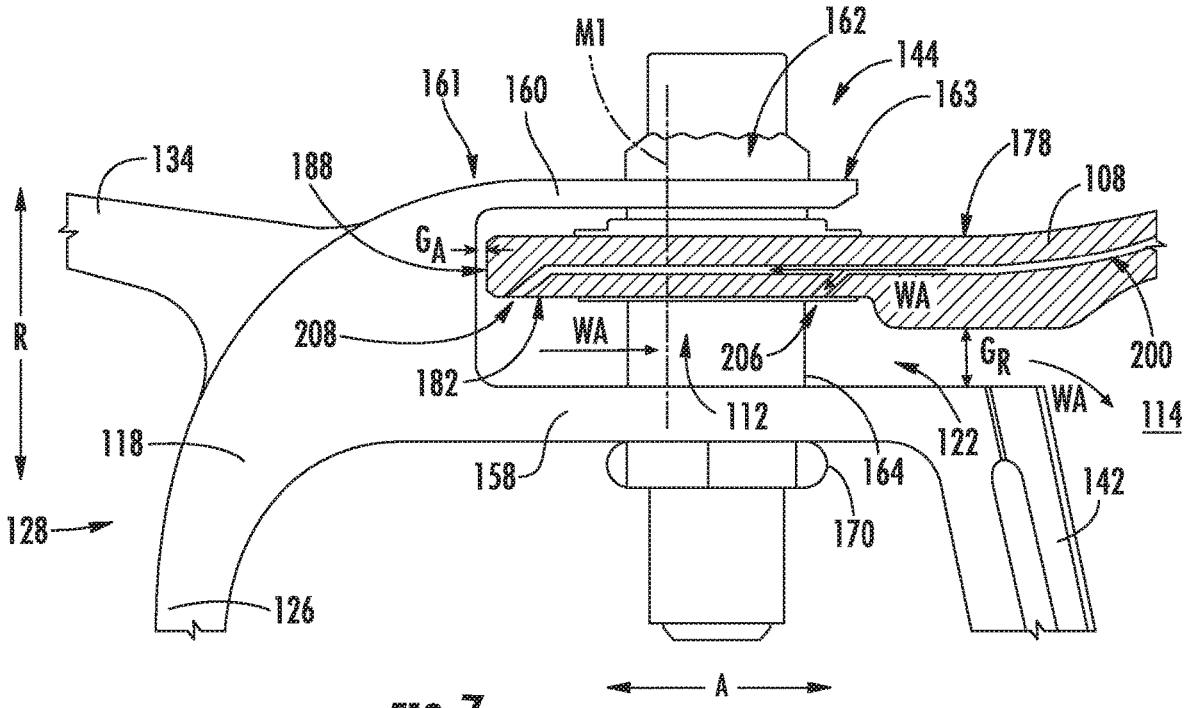
FIG. 7 provides a close up, cross-sectional view of another exemplary embodiment of a combustor assembly depicting a forward end of an outer liner attached to an outer dome section and further depicting a warming passage defined by the outer liner.

FIG. 7 provides a cross section a close up, cross-sectional view of forward end 112 of outer liner 108 attached to outer dome 118 with warming passage 200 shown defined by the outer liner 108. For this embodiment, the forward end 112 of the outer liner 108 defines a plurality of outlets, including a first outlet 206 and a second outlet 208. As shown, the first outlet 206 is defined by the inner surface 182 of the outer liner 108 at its forward end 112 and the second outlet 208 is likewise defined by the inner surface 182 of the outer liner 108 at its forward end 112. More particularly, as shown, the first outlet 206 is defined by the inner surface 182 of the outer liner 108 at a position along the forward end 112 that is received within slot 122 and the second outlet 208 is defined by the inner surface 182 of the outer liner 108 at a position along the forward end 112 that is received within slot 122. More particularly still, as shown, the yolk 160 defines a midline M1 extending midway between its forward end 161 and its aft end 163 along the axial direction A, and for this embodiment, the first outlet 206 is defined at a position between the midline M1 and the aft end 163 of the yolk 160 and the second outlet 208 is defined at a position between the midline M1 and the forward end 161 of the yolk 160, and specifically, the second outlet 208 is positioned forward of the mounting assembly 144. Accordingly, the first outlet 206 is positioned aft of the midline M1 and the second outlet 208 is positioned forward of the midline M1. By positioning the first outlet 206 as shown in FIG. 7, the forward end 112 positioned aft of the midline M1 may be warmed with warming airflow WA as described above. Further, by positioning the second outlet 208 as shown in FIG. 7, the warming passage 200 extends substantially along the axial length of the forward end 112 and thus warming air WA is provided to a location forward of the midline M1. This, among other benefits, may provide for optimal warming of the forward end 112. In alternative exemplary embodiments, the forward end 112 may define more than two outlets along the inner surface 182 of the outer liner 108. For instance, in some embodiment, the forward end 112 may define at least four (4) outlets along the inner surface 182 of the outer liner 108.

Figure 8:
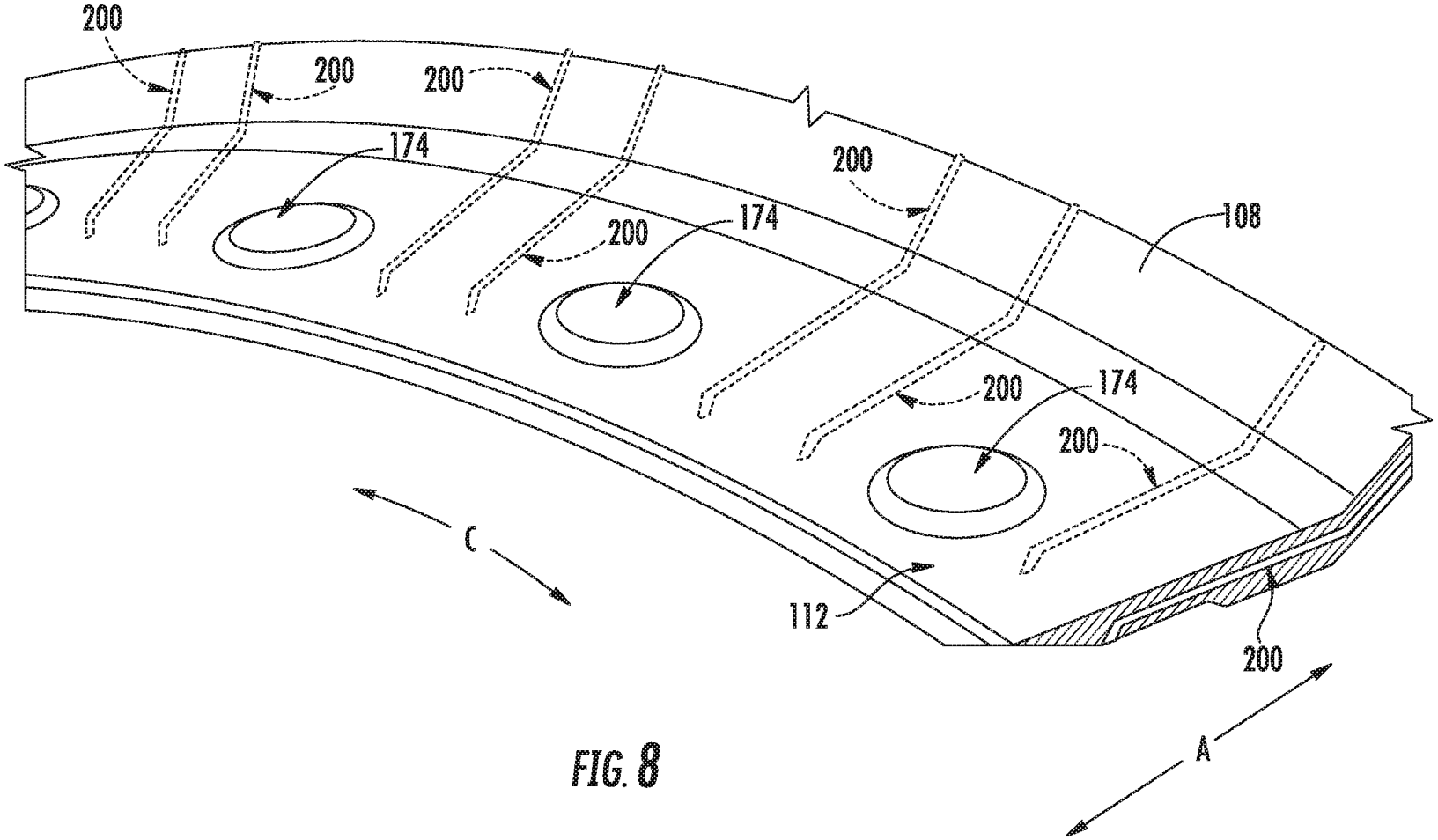
FIG. 8 provides a close up, perspective view of an outer liner defining a plurality of warming passages in accordance with an exemplary embodiment of the present disclosure.

FIG. 8 provides a close up, perspective view of the outer liner 108 depicting a plurality of warming passages 200 defined by the outer liner 108 (some of the warming passages 200 shown in phantom in FIG. 8). In some embodiments, as shown, the warming passage 200 is one of a plurality of warming passages defined by the outer liner 108. For this embodiment, the warming passages 200 are spaced apart from one another along the circumferential direction C. Further, as shown, multiple warming passages 200 may be defined adjacent or between mounting openings 174 (or mounting assemblies 144; FIG. 3). For this embodiment, two (2) warming passages 200 are shown positioned between each of the mounting openings 174. In alternative exemplary embodiments, more or less than two (2) warming passages 200 may be defined by the outer liner 108 between the mounting openings 174.

Figure 9:
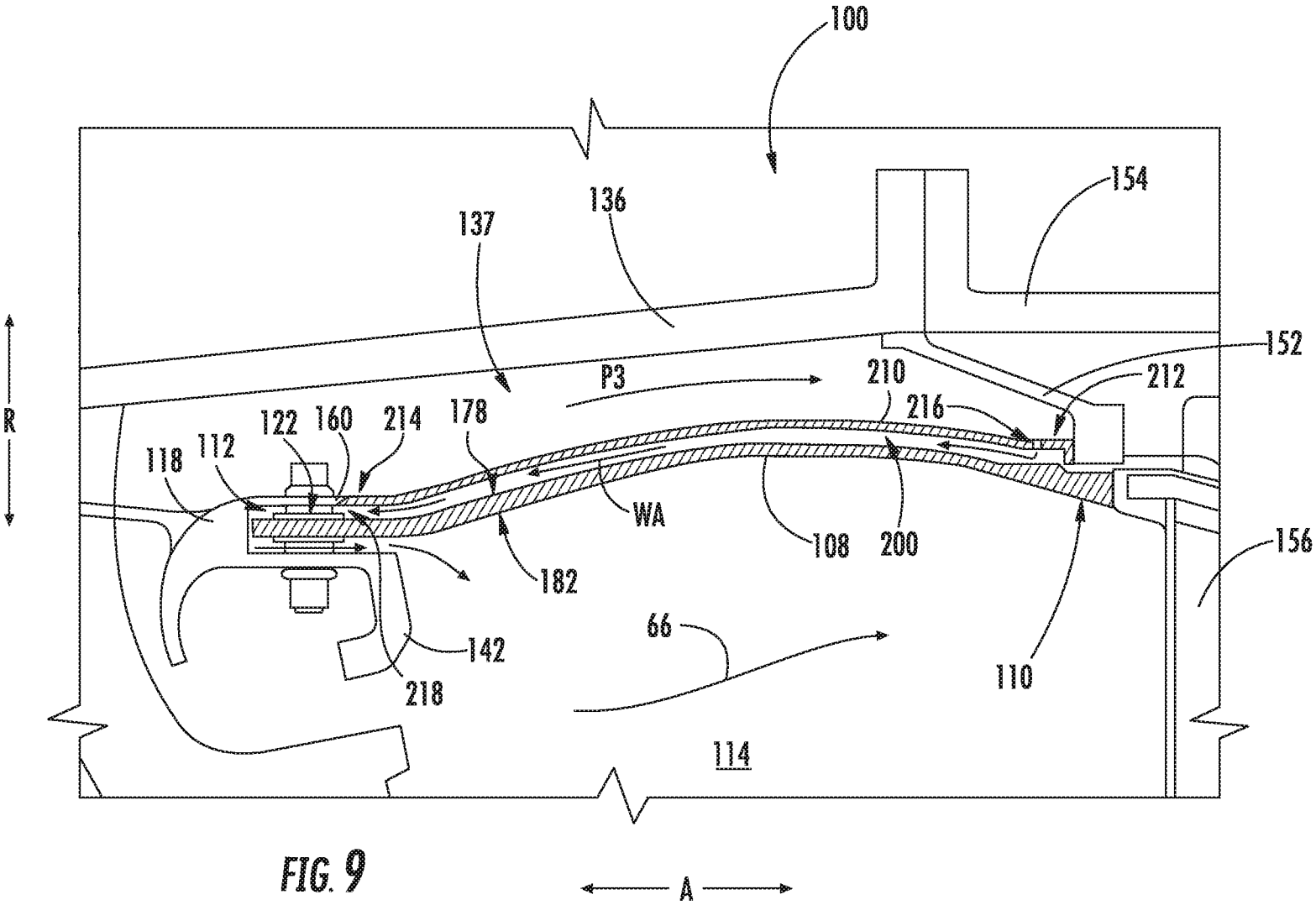
FIG. 9 provides a schematic, cross-sectional view of one exemplary embodiment of a combustor assembly depicting a forward end of an outer liner attached to an outer dome section and a baffle attached to the outer dome section and further depicting the liner and the baffle defining a warming passage in accordance with an exemplary embodiment of the present disclosure.

FIG. 9 provides a schematic, cross-sectional view of one exemplary embodiment of combustor assembly 100 depicting forward end 112 of outer liner 108 attached to outer dome 118 and a baffle 210 attached to the outer dome 118. FIG. 9 further depicts the outer liner 108 and the baffle 210 defining warming passage 200. The baffle 210 may be formed of a metallic material, a CMC material, or another suitable material.

As shown in FIG. 9, the baffle 210 extends between an aft end 212 and a forward end 214. For this embodiment, the baffle 210 extends generally along the axial direction A between aft end 212 and forward end 214. The forward end 214 of the baffle 210 is attached to the outer dome 118. More particularly, the forward end 214 of the baffle 210 is attached to the yolk 160 of the outer dome 118, and thus, the forward end 214 of the baffle 210 is positioned proximate the forward end 112 of the outer liner 108 along the axial direction A. The aft end 212 of the baffle 210 is attached to a structural member 152 positioned at the aft end of the combustion section 26 (FIG. 1) as shown in FIG. 9, and thus, the aft end 212 of the baffle 210 is positioned proximate the aft end 110 of the outer liner 108 along the axial direction A. Accordingly, for this embodiment, the baffle 210 extends substantially along the axial length of the outer liner 108. Furthermore, as the baffle 210 extends along the axial direction A, the baffle 210 is spaced from the outer liner 108 along the radial direction R in a direction opposite the combustion chamber 114. For this exemplary embodiment, the direction opposite the combustion chamber 114 is radially outward of the outer liner 108. In embodiments where baffle 210 is attached to inner dome 116 (FIG. 2), a direction opposite the combustion chamber 114 is radially inward of the inner liner 102.

For the depicted embodiment of FIG. 9, warming passage 200 is defined between the outer liner 108 and the baffle 210, and more particularly, the warming passage 200 is defined between the outer surface 178 of the outer liner 108 and the inner surface of the baffle 210. The warming passage 200 extends between an inlet 216 and outlet 218. For the depicted embodiment of FIG. 9, the baffle 210 defines the inlet 216 of the warming passage 200 aft of the forward end 112 of the outer liner 108 and the outlet 218 is at least partially defined by the forward end 112 of the outer liner 108. More particularly, for this embodiment, the inlet 216 is defined by the baffle 210 proximate the aft end 212 of the baffle 210 along the axial direction A. The outlet 218 is defined in part by the forward end 112 of the outer liner 108 and the yolk 160 of the outer dome 118. In this way, the outlet 218 of the warming passage 200 is located at the entrance or inlet of the slot 122.

During operation of the turbofan engine 10 (FIG. 1), with reference to FIG. 9, pressurized air P3 (e.g., compressor discharge air) is discharged from the compressor section (FIG. 1). A portion of the pressurized air P3 flows aft in the axial direction A in or through outer plenum 137 defined between the baffle 210 and the outer combustor casing 136 along the radial direction R. As the pressurized air P3 flows aft toward the aft end 212 of the baffle 210, some of the pressurized air P3 flows into the inlet 216 of the warming passage 200. The pressurized air P3 then flows in a forward direction along the axial direction A, or stated alternatively, the pressurized air P3 flows upstream relative to the combustion gasses 66 generated within the combustion chamber 114. As the pressurized air P3 flows through warming passage 200, heat conducting through the outer liner 108 transfers to the pressurized air P3, thereby generating a warming airflow WA. That is, heat conducts through the outer liner 108 from its hot inner surface 182 radially outward toward warming passage 200. The heat is then transferred to the pressurized air P3 to generate a warming airflow WA, which is warmed pressurized air. The warming airflow WA continues forward through the warming passage 200 and eventually reaches the outlet 218 of the warming passage 200. The warming airflow WA flows through the outlet 218 and into slot 122. Outlet 218 and slot 122 are in fluid communication with one another, and as shown in the depicted embodiment of FIG. 9, the outlet 218 of the warming passage 200 and the slot 122 defined generally by the outer dome 118 form a contiguous channel.

As the warming airflow WA travels through slot 122, the warming airflow WA exchanges heat with the relatively cooler forward end 112 of the outer liner 108. In this way, the forward end 112 is warmed. In particular, as warming airflow WA flows through slot 122 between the yolk 160 and the outer surface 178 of the outer liner 108, some of the warming airflow WA scrubs along the outer surface 178 of the outer liner 108 to warm the forward end 112. Then, the warming airflow WA flows radially inward through the axial gap $G_A$ (FIG. 3), and as this occurs, some of the warming airflow WA scrubs along the radial interface surface 188 of the outer liner 108 to warm the forward end 112. Thereafter, as warming airflow WA flows through slot 122 between the baseplate 158 and the inner surface 182 of the outer liner 108, some of the warming airflow WA scrubs along the inner surface 182 of the outer liner 108 to warm the forward end 112 and then continues forward through the radial gap $G_R$ (FIG. 3) and into the combustion chamber 114. As noted previously, by warming the forward end 112 of the outer liner 108, the thermal response of the forward end 112 can be improved during transient operations of the turbofan engine 10 (FIG. 1) and the thermal gradient between the forward end 112 and the other portions of outer liner 108 can be reduced or eliminated during steady state operation. As such, the stress and strain on the outer liner 108 can be reduced during transient and steady state operation of the engine.

Figure 10:
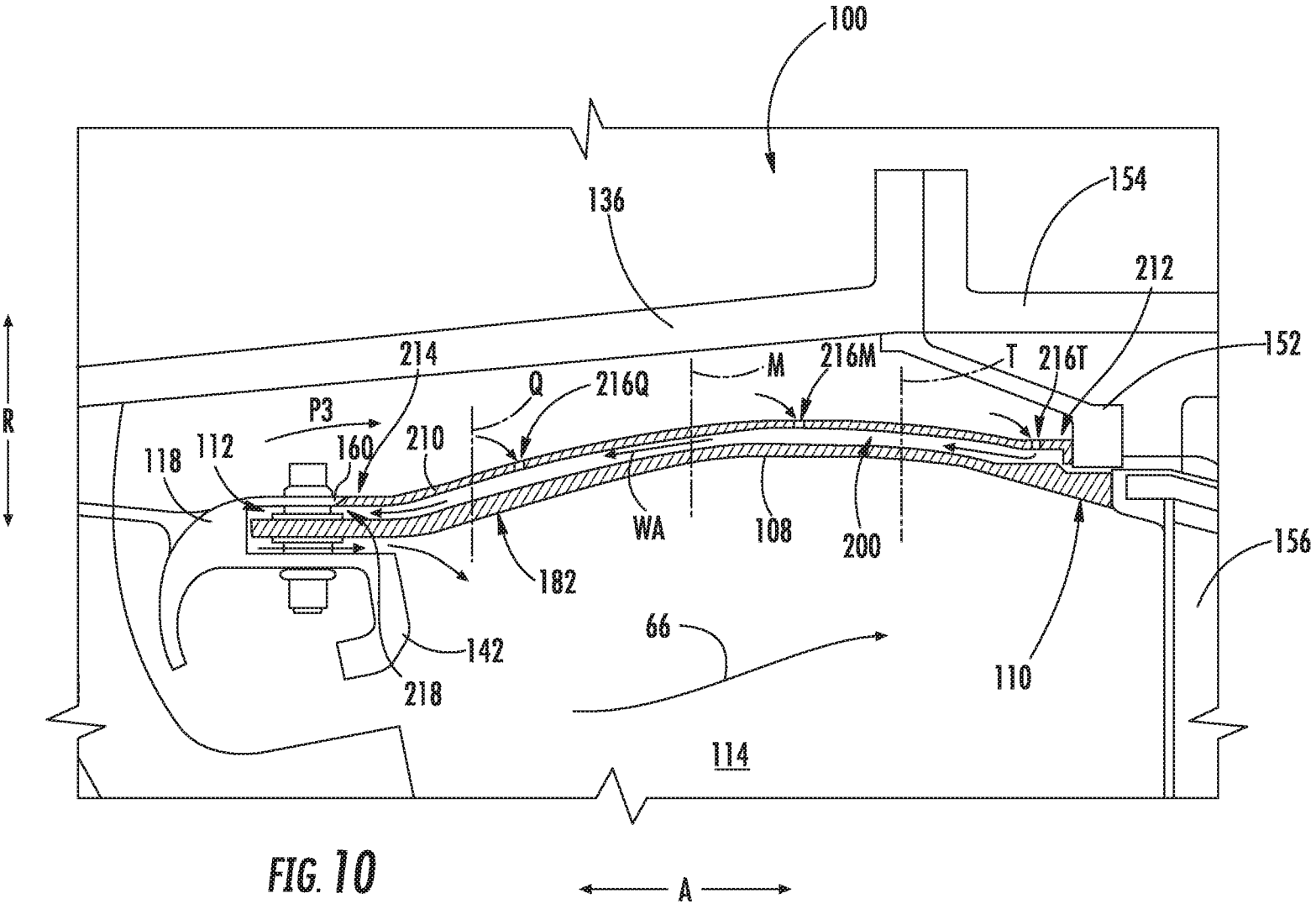
FIG. 10 provides a schematic, cross-sectional view of exemplary embodiments of a combustor assembly depicting a forward end of an outer liner attached to an outer dome section and a baffle and the outer liner defining warming passage.
Figure 11:
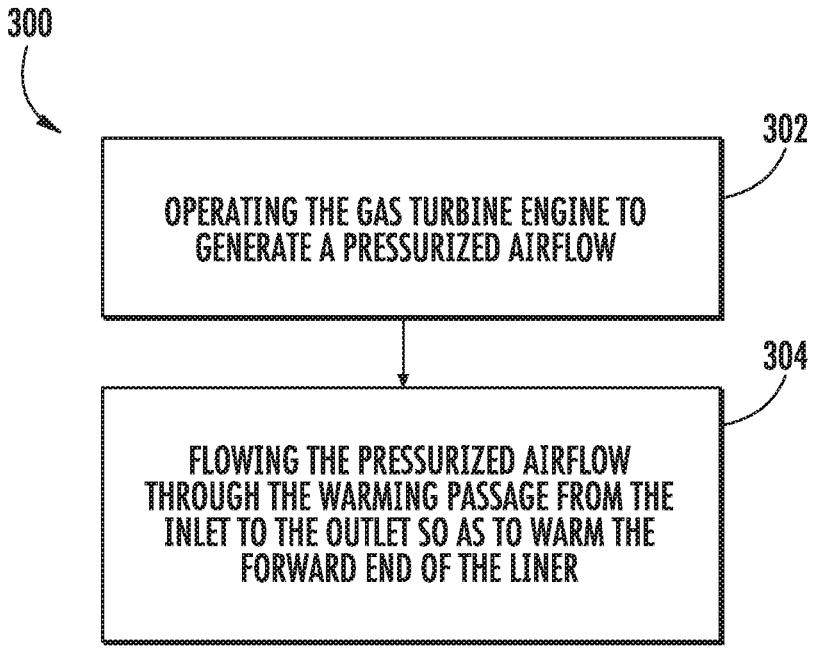
FIG. 11 provides a flow diagram of an exemplary method for warming a liner of a combustor assembly of a gas turbine engine in accordance with an exemplary embodiment of the present disclosure.

FIG. 10 provides a schematic, cross-sectional view of exemplary embodiments of combustor assembly 100 depicting forward end 112 of outer liner 108 attached to outer dome 118 and baffle 210 and outer liner 108 defining warming passage 200. In some embodiments, as shown in FIG. 10, outer liner 108 defines midplane M between the aft end 110 and the forward end 112 of the outer liner 108. Further, the outer liner 108 defines quarter plane Q between the midplane M and its forward end 112 and three-quarter plane T between the midplane M and its aft end 110. In some embodiments, the inlet of the warming passage 200 is defined by the baffle 210 at or aft of the midplane M. For instance, as shown in FIG. 10, the inlet 216M is defined by baffle 210 aft of the midplane M. In yet other embodiments, the inlet 216 is defined by the baffle 210 at or aft of the quarter plane Q. For instance, as shown in FIG. 10, the inlet 216Q is defined by baffle 210 aft of the quarter plane Q. In further embodiments, the inlet is defined by the baffle 210 at or aft of the three-quarter plane T. For instance, as shown in FIG. 10, the inlet 216T is defined by the baffle 210 aft of the three-quarter plane T. In embodiments where the inlet 216 is not positioned proximate the aft end 110 of the outer liner 108 along the axial direction A, e.g., where the inlet is positioned at the midplane M along the axial direction A, the baffle 210 need not extend substantially the axially length of the outer liner 108. For instance, where the inlet is defined by the baffle 210 at the midplane M along the axial direction A, the aft end 212 of the baffle 210 may only extend just aft of the inlet 216, e.g., at some location between the midplane M and the three-quarter plane T along the axial direction A. In such embodiments, the baffle 210 may be attached at its aft end 212 to any suitable structure to secure baffle 210 in place. For instance, the baffle 210 can be attached to the outer surface 178 of the outer liner 108.

In some embodiments, the warming passage 200 is one of a plurality of individual or segmented passages defined by the outer liner 108. In such embodiments, the plurality of warming passages 200 are spaced along the along the circumferential direction C. Each warming passage 200 can include sidewalls extending along the axial length of the passage to partition or segment the passage from adjacent passages. Alternatively, the warming passages 200 can be spaced from one another along the circumferential direction C. That is, the warming passages can be spaced by a circumferentially extending gap, and in such embodiments, the baffle includes a plurality of circumferentially spaced segments. In yet other embodiments, the baffle may extend annularly about the liner along the circumferential direction such that warming passage 200 is an annular passage extending three hundred sixty degrees (360°) about the circumferential direction C.

FIG. 10 provides a flow diagram of an exemplary method (300) for warming a forward end of a liner of a combustor assembly for a gas turbine engine in accordance with an exemplary embodiment of the present disclosure. The gas turbine engine defines a radial direction, an axial direction, and a circumferential direction. The combustor assembly includes a dome defining a slot. The forward end of the liner is received within the slot. The liner at least partially defines a combustion chamber and at least partially defines a warming passage. The warming passage extends between an inlet and an outlet. The inlet is positioned upstream of the outlet and the outlet is at least partially defined by the forward end of the liner. That is, the inlet is positioned upstream of the outlet relative to the flow of combustion gases through the combustion chamber. The gas turbine engine can be, for example, the turbofan engine 10 of FIG. 1. The combustor assembly can be one of the exemplary combustor assemblies 100 disclosed herein. For instance, the dome can be the outer dome 118 or the inner dome 116. The forward end can be the forward end 112 of the outer liner 108 or the forward end 106 of the inner liner 102. In some implementations, the liner is formed of a CMC material and the dome is formed of a metal material.

At (302), the method includes operating the gas turbine engine to generate a pressurized airflow. For instance, the turbofan engine 10 (FIG. 1) can be operated to generate compressor discharge air, or pressurized airflow P3. The P3 air may exit the compressor section and flow downstream to the combustion section. For instance, some the P3 air can flow into combustion chamber 114 to mix with fuel to generate combustion gases 66, some of the P3 air can flow into an outer plenum 137 between the outer liner 108 (or baffle 210 in some embodiments) and the outer combustor casing 136, and some of the P3 air can flow into an inner plenum between the inner liner 102 and one or more structures positioned radially inward of the inner liner 102, such as e.g., annular support member 140.

At (304), the method includes flowing the pressurized airflow through the warming passage from the inlet to the outlet so as to warm the forward end of the liner. As one example, with reference again to FIG. 5, the pressurized airflow P3 can flow into the inlet 202 and along the warming passage 200 defined by the outer liner 108. In addition, as discussed previously, as the pressurized airflow P3 flows along the warming passage 200, heat conducting through the outer liner 108 transfers to the pressurized airflow, thereby generating a pressurized warming airflow WA. The warming airflow WA continues flowing forward along the axial direction A (or upstream relative to the general flow of fluids through the turbofan engine 10). The warming airflow WA reaches the forward end 112 and warms the forward end 112 of the outer liner 108. This may, as discussed previously, may reduce the bending stress and strain on the liner caused by thermal lag during transient operations and may also reduce the bending stress and strain on the liner caused by a steep thermal gradient between the forward end and the other portions of the liner during steady state operation. As another example, with reference to FIG. 9, the pressurized airflow P3 can flow through the warming passage 200 defined in part by the outer liner 108 and defined in part by the baffle 210 from the inlet 216 to the outlet 218 so as to warm the forward end 112 of the outer liner 108. This may reduce the bending stress and strain on the liner during both transient and steady state operation of the gas turbine engine.

In some implementations of method (300), the liner defines a midplane between the aft end and the forward end of the liner. In such implementations, the inlet is defined by the liner upstream of the midplane. For instance, as shown in FIG. 5, the inlet 202M is defined by the outer liner 108 upstream of the midplane M. As another example, as shown in FIG. 4, the inlet 202 is defined by the outer liner 108 upstream of the midplane M, and more particularly, the inlet 202 is defined by the outer liner 108 proximate the aft end 110 of the outer liner 108 along the axial direction A. In yet other implementations of the method (300), the liner defines a midplane between the aft end and the forward end of the liner. In such implementations, the inlet is defined by the baffle upstream of the midplane. For instance, as shown in FIG. 10, the inlet 216M is defined by the baffle 210 upstream of the midplane M. As another example, as shown in FIG. 9, the inlet 216 is defined by the baffle 210 upstream of the midplane M, and more particularly, the inlet 216 is defined by the baffle 210 proximate the aft end 110 of the outer liner 108 along the axial direction A.

In some implementations of method (300), the liner extends between an outer surface and an opposing inner surface along the radial direction. In such implementations, the warming passage is defined by the liner approximately midway between the outer surface and the inner surface. In yet other implementations, the combustor assembly includes a baffle extending between an aft end and a forward end. In such implementations, the forward end of the baffle is attached to the dome and the baffle is spaced from the liner in a direction opposite the combustion chamber along the radial direction. Further, in such implementations, the warming passage is defined between the baffle and the liner.

Although the exemplary embodiments of the present disclosure were discussed and illustrated primarily using the outer liner and outer dome section of the combustor assembly, it will be appreciated that each exemplary aspect disclosed herein is applicable to the inner liner and inner dome section of the combustor assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine defining an axial direction, a radial direction, and a circumferential direction, the combustor assembly comprising:

a dome including a yoke and a base plate spaced from the yoke along the radial direction such that a slot is defined between the yoke and the base plate in the radial direction;

a liner extending along the axial direction between an aft end and a forward end, the forward end positioned within the slot, the aft end positioned aft of the slot in the axial direction, the liner further extending along the radial direction between an inner surface and an outer surface, the inner surface partially defining a combustion chamber, the liner defining a warming passage positioned between the inner surface and the outer surface along the radial direction, the warming passage extending from an inlet defined by the outer surface to an outlet defined by the inner surface, the inlet spaced apart from and positioned aft of the outlet and the dome in the axial direction, and the outlet defined by the forward end of the liner and positioned within the slot such that the warming air exits the outlet and flows through the slot into the combustion chamber; and a mounting assembly coupling the dome and the forward end of the liner, the mounting assembly spaced apart from the warming passage along the circumferential direction and positioned forward of the outlet in the axial direction.

2. The combustor assembly of claim 1, wherein the inlet is defined by the liner proximate the aft end of the liner along the axial direction.

3. The combustor assembly of claim 1, wherein a midplane is defined between the aft end and the forward end of the liner, and wherein the inlet is defined by the liner at or aft of the midplane.

4. The combustor assembly of claim 1, wherein a midplane is defined between the aft end and the forward end of the liner and a quarter plane is defined between the midplane and the forward end of the liner, and wherein the inlet is defined by the liner at or aft of the quarter plane.

5. The combustor assembly of claim 1, wherein the liner is an outer liner of the combustor assembly, and wherein the inlet is defined by the outer surface.

6. The combustor assembly of claim 1, wherein the liner is an outer liner of the combustor assembly, and wherein the outlet is defined by the inner surface.

7. The combustor assembly of claim 1, wherein the liner is an outer liner of the combustor assembly, and wherein the outlet comprises a first outlet; and a second outlet of the warming passage axially spaced from the first outlet, wherein the first outlet and the second outlet are each defined by the inner surface of the forward end of the outer liner.

8. The combustor assembly of claim 1, wherein the liner is formed of a ceramic matrix composite (CMC) material.

9. The combustor assembly of claim 1, wherein the warming passage is one of a plurality of warming passages defined by the liner, the plurality of warming passages spaced apart from one another along the circumferential direction.

* * * * *